US006386658B1

(12) United States Patent
Dietrich et al.

(10) Patent No.: US 6,386,658 B1
(45) Date of Patent: May 14, 2002

(54) HOUSING FOR A PACKAGING MACHINE

(75) Inventors: Walter Dietrich; Eberhard Krieger, both of Weinstadt; Ulrich Wieduwilt, Schwaebisch; Klaus Stoeckel, Korb, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/623,226

(22) PCT Filed: Dec. 28, 1999

(86) PCT No.: PCT/DE99/04110

§ 371 Date: Nov. 3, 2000

§ 102(e) Date: Nov. 3, 2000

(87) PCT Pub. No.: WO00/40466

PCT Pub. Date: Jul. 13, 2000

(30) Foreign Application Priority Data

Dec. 30, 1998 (DE) ..... 198 60 765

(51) Int. Cl.[7] ..... E06B 9/13

(52) U.S. Cl. ..... 312/297

(58) Field of Search ..... 312/3, 4, 208.3, 312/284, 297, 350; 109/11, 15, 49.5; 141/97; 160/37, 230, 352

(56) References Cited

U.S. PATENT DOCUMENTS 3,814,493 A * 6/1974 Radke ..... 312/297
4,407,341 A * 10/1983 Feldt et al. ..... 141/97

FOREIGN PATENT DOCUMENTS

DE 8215589 * 9/1982
EP 737620 * 10/1996

* cited by examiner

*Primary Examiner*—James O. Hansen
(74) *Attorney, Agent, or Firm*—Ronald E. Greigg

(57) ABSTRACT

A housing for a packaging machine. The housing has guides for at least one protective plate disposed in side walls of the housing. The at least one protective plate is supported in the guides by rollers. It is essential that the protective plate can be moved in the guides in such a way that the protective plate is possible to freely access a region disposed inside the housing, the opening of the housing does not require any additional floor space for the packaging machine.

14 Claims, 7 Drawing Sheets

HOUSING FOR A PACKAGING MACHINE

PRIOR ART

The invention relates to a housing, for a packaging machine. A generally known housing for packaging machines with protective plates disposed on the front side of the housing, where the protective plates are embodied as pivotable, preferably transparent doors or hoods. For example in the event of adjusting or retooling work, these doors or hoods provide rapid access to the relevant regions inside the packaging machine. It is disadvantageous that the pivoting region of the doors or hoods in front of the packaging machine must be kept clear, which increases the floor space required by the packaging machine. Therefore a multitude of relatively small doors or hoods with a consequently reduced pivot region are often used in order to keep the required floor space as small as possible. However, a larger number of doors or hoods increases the cost of the packaging machine. There are also known housings with protective devices in the form of roller blinds which are comprised of strips that are connected to one another in an articulating fashion. However, the transparency required for optical monitoring of the manufacturing process is difficult to produce in roller blinds of this kind. They are also expensive due to the numerous swivel joints connecting the strips of the roller blind to one another and the noise damping is often insufficient.

ADVANTAGES OF THE INVENTION

The housing according to the invention, has an advantage over the prior art that no additional floor space is required when opening the housing and at the same time, when the housing is closed, the invention permits the protected region of the packaging machine to be seen and permits a favorable noise damping.

Other advantages and advantageous improvements of the housing according to the invention, in particular for a packaging machine, ensue from the dependent claims and the description.

BRIEF DESCRIPTION OF THE DRAWINGS

Exemplary embodiments of the invention are depicted in the drawings and will be explained in detail below.

DESCRIPTION OF THE EXEMPLARY EMBODIMENTS

Figure 1:
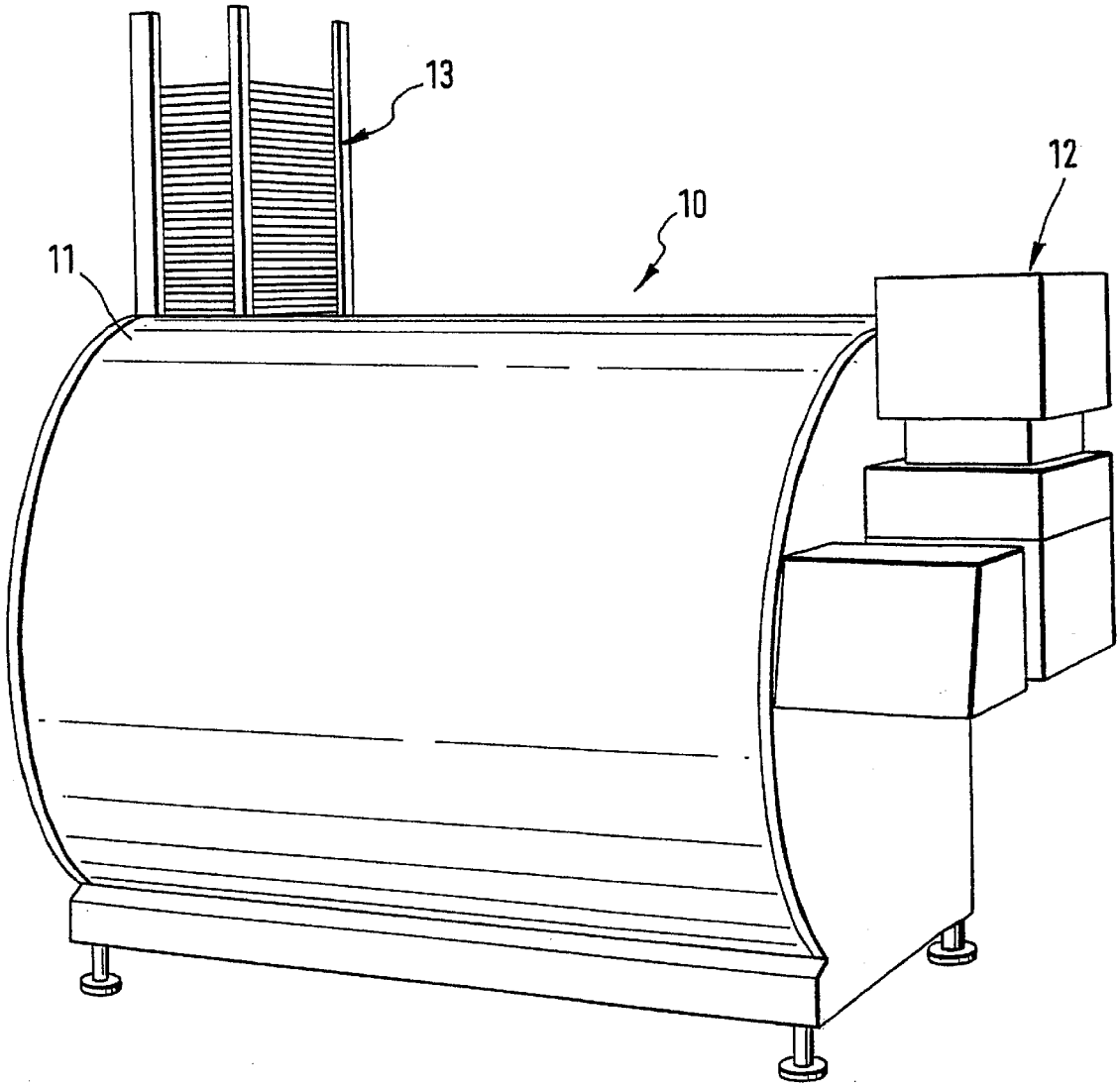
FIG. 1 shows a simplified perspective view of a packaging machine.

FIGS. 1 to 5 show a manufacturing device in the form of a first packaging machine 10. The packaging machine 10, for example a cartoning machine, has a housing 11. On the outside of the housing 11, there is a command and control device 12 and a storage magazine 13 for flat carton blanks.

On the inside the housing 11, there is an essentially vertically extending dividing wall 15 and, in the lower region, an inclined bottom covering 16, which divide the packaging machine 10 lengthwise. Inside the housing 11, the dividing wall 15 and the bottom covering 16 divide a production chamber 18 from a drive and machine chamber 19. In the case of a cartoning machine, for example, conveying or manipulating devices for folding boxes as well as insertion devices for introducing items into the folding boxes are disposed inside the production chamber 18. These devices are driven from the drive and machine chamber 19 for which purpose the dividing wall 15 has corresponding openings, not shown, for example for drive shafts.

The packaging machine 10 is especially equipped on the one hand to protect the production chamber 18 from unauthorized or unintentional intrusions and to protect it from dirt, and on the other hand in order to permit access to the devices disposed in the production chamber 18 for adjusting work or in the event of production malfunctions. To that end, the two plate-shaped side walls 20, which are embodied as rounded on the front side of the packaging machine 10 or in the vicinity of the production chamber 18 and which are part of the otherwise essentially block-shaped packaging machine 10, have groove-shaped guides 21, 22 toward the production chamber 18, which are for a arc-shaped or annular section-shaped guiding and forming strip 23 and a flexible rectangular protective plate 25 preferably made of plexiglass. Furthermore, in at least one of the side walls 20 of the housing 11, in the vicinity of the production chamber 18, there is an opening 26 into which the above-mentioned conveying and manipulating devices, not shown, protrude.

The guides 21, 22 in the two side walls 20, which are oriented toward and aligned with each other, are preferably milled into the side walls 20. The length of the guides 21, 22 is dimensioned so that when the protective plate 25 is closed, the protective plate protrudes to an upper, horizontally extending housing wall section 27 so that the production chamber 18 is completely closed.

Figure 4:
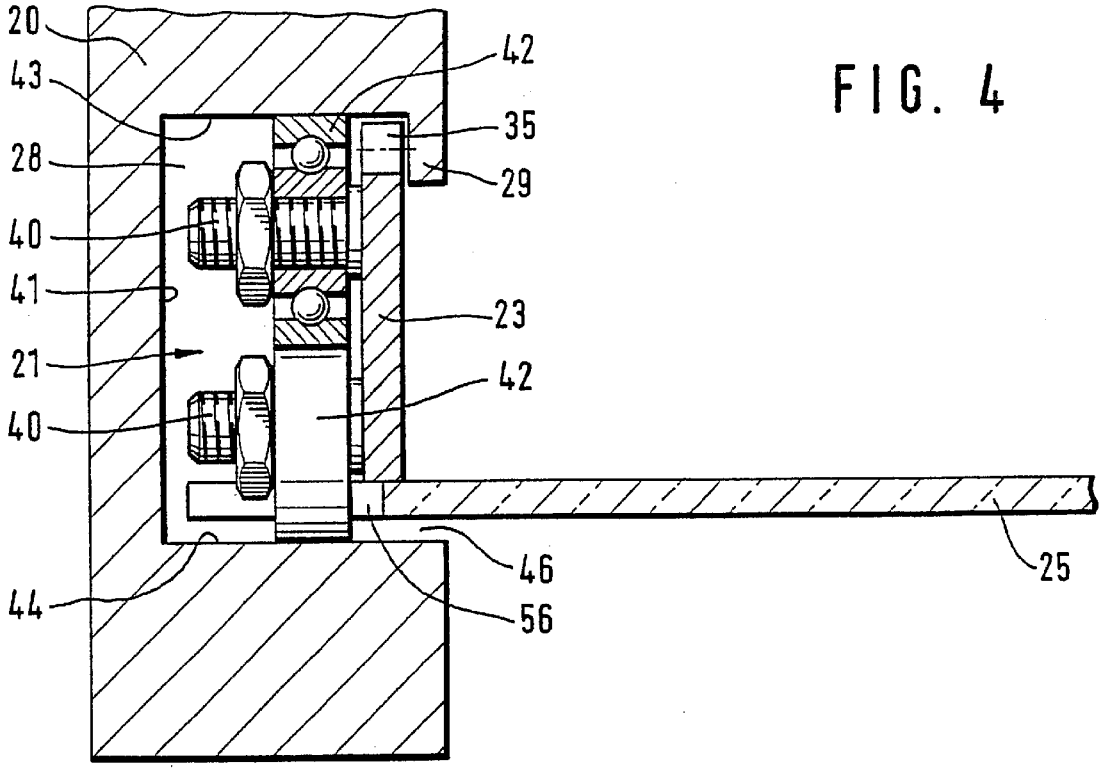
FIGS. 4 and 5 show views in the direction IV—IV and V—V in FIG. 3, FIGS. 6 and 7 show simplified cross sections through a modified packaging machine, with different positions of the protective plates.
Figure 5:
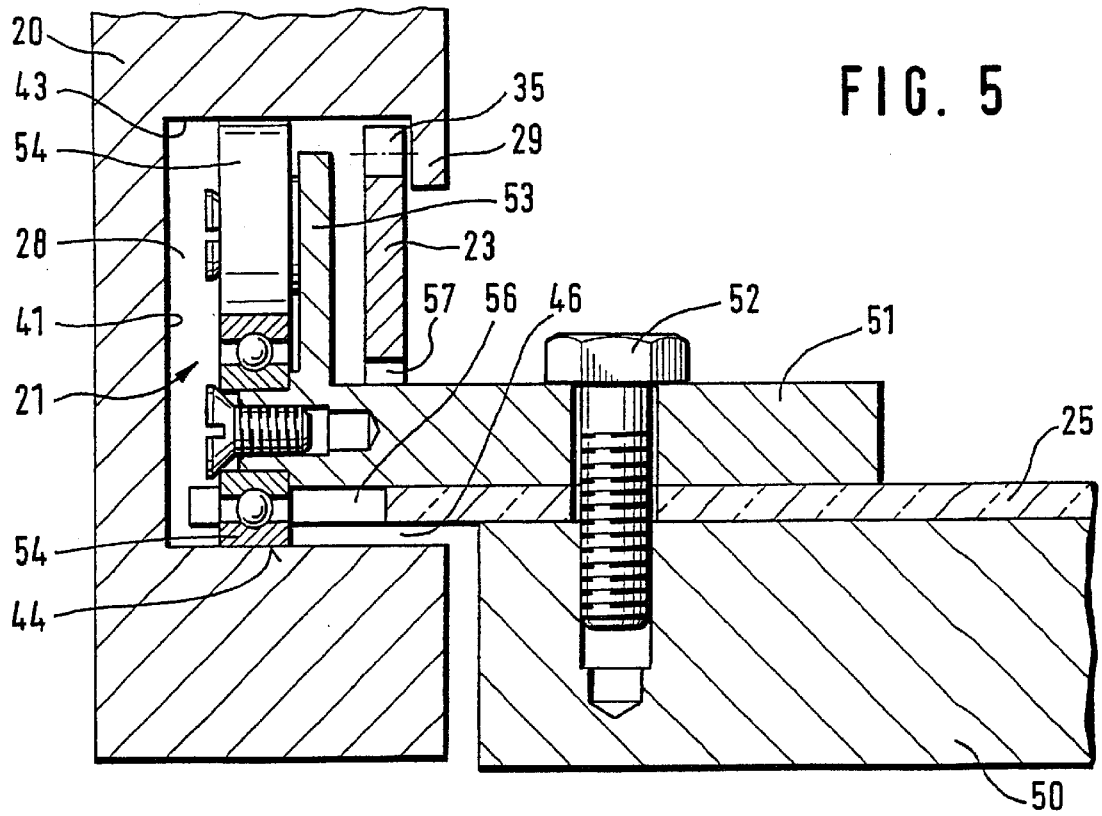
Figure 6:
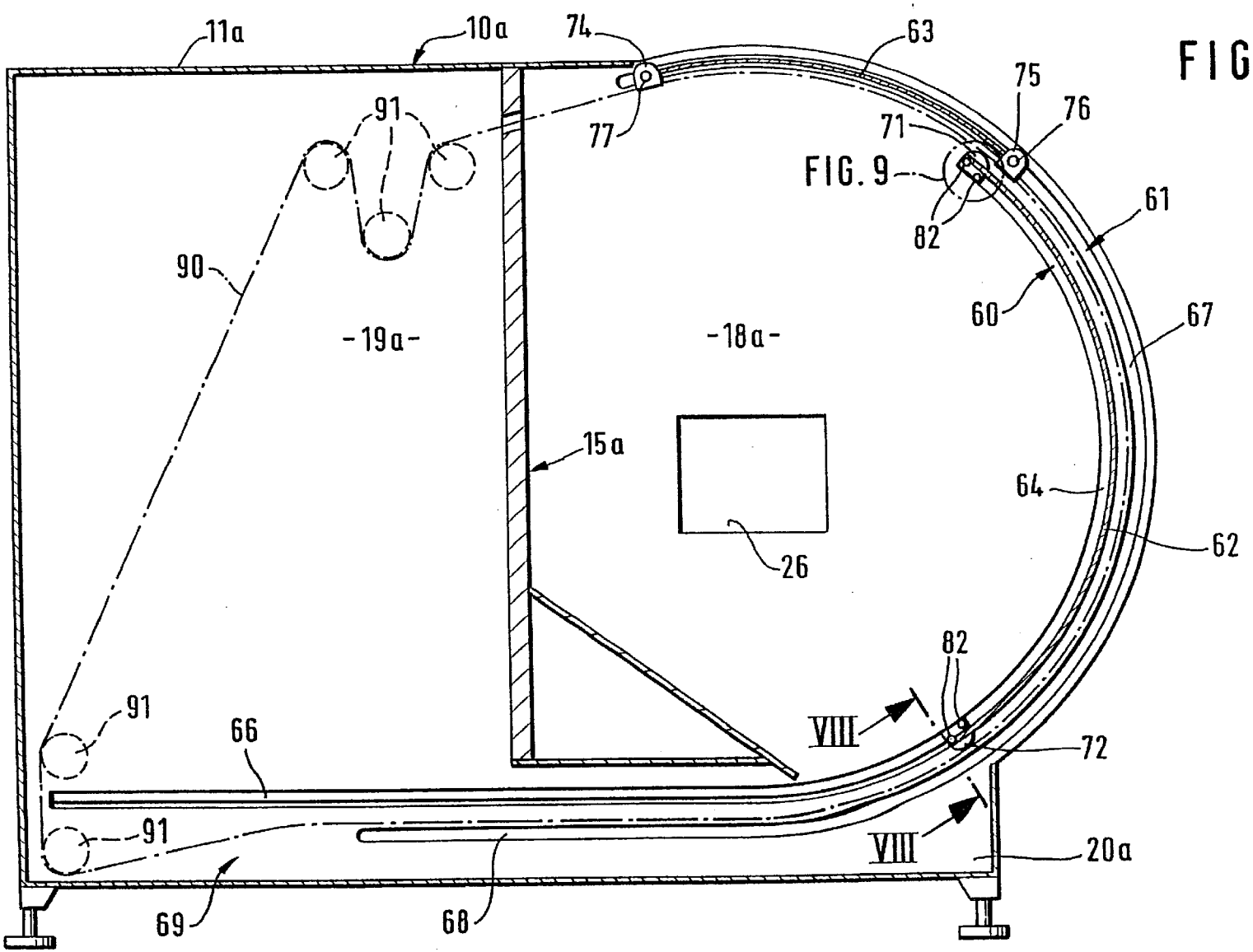

Whereas the one guide 21 is embodied as arc-shaped, the other straight guide 22 branches off from the one guide 21 at a branch 24 beneath the bottom covering 16. As can be seen in FIGS. 4 and 5, the one guide 21, which is otherwise embodied as a rectangular groove 28, has a projection 29, at least in the vicinity of the production chamber 18, in order to guide the guiding and forming strip 23 inside the groove 28.

The guiding and forming strip 23, which is disposed in the guide 21, is comprised of two parts 31, 32 by means of a connection 33 in the first exemplary embodiment, and has a total of approximately half the arc length of the guide 21, has a gearing 35 on its inner surface. The gearing 35 engages with a gear 36 disposed underneath the bottom covering 16. The two gears 36 in the two side walls 20 are rigidly connected to each other by means of a shaft 37, which in the case of a motor drive, is preferably used to introduce a drive moment into the guiding and forming strips 23.

In the back region of the guide 21 there are also a number of guide disks 39 which partially cover the guide 21. The guide disks 39 hold the guiding and forming strip 23 in this region inside the guide 21 since its groove 28 does not have a projection 29 there. The projection 29 is left out in this vicinity in order to permit a simple introduction of the guiding and forming strip 23 into the guide 21 during assembly of the housing 11.

So that the guiding and forming strip 23 can be moved in the guide 21 with as little friction is possible, rollers 42 are supported in rotary fashion on bearing pins 40 on the side of the guiding and forming strip 23 oriented toward the groove bottom 41. The rollers 42, whose diameter is less than the groove width, are disposed in such a way that they are alternatingly supported against opposing groove side walls 43, 44. In this connection, the gearing 35 is disposed close to the one groove side wall 43 so that the gearing 35 is protected against the penetration of dirt by the projection 29. Between the side of the guiding and forming strip 23 opposite from the gearing 35 and the other groove side wall 44, however, an intermediary space 46 is embodied, into which the protective plate 25 protrudes, wherein this protective plate rests against the guiding and forming strips 23 and is only spaced apart from the groove side wall 44.

A closing and grasping strip 50 is respectively fastened to the protective plate 25 at the front edge 47 and the back edge 48 of the protective plate 25, on the side remote from the guiding and forming strip 23. This is preferably achieved by means of a connecting angle 51, which is disposed on the opposite side of the closing and grasping strip 50 (FIG. 5). The connecting angle 51 and the closing and grasping strip 50 are connected to each other by means of a screw 52 which passes through a corresponding hole in the protective plate 25. Two additional rollers 54 disposed offset from each other are supported so that they can rotate on a leg 53 that protrudes at right angles from the connecting angle 51. So that the protective plate 25 can protrude as far as possible into the guides 21, 22, the protective plate 25 has recesses 56 in the vicinity of the connecting angle 51 or the rollers 54 and on the side opposite from the gearing 35 in the vicinity of the rollers 42.

Figure 3:
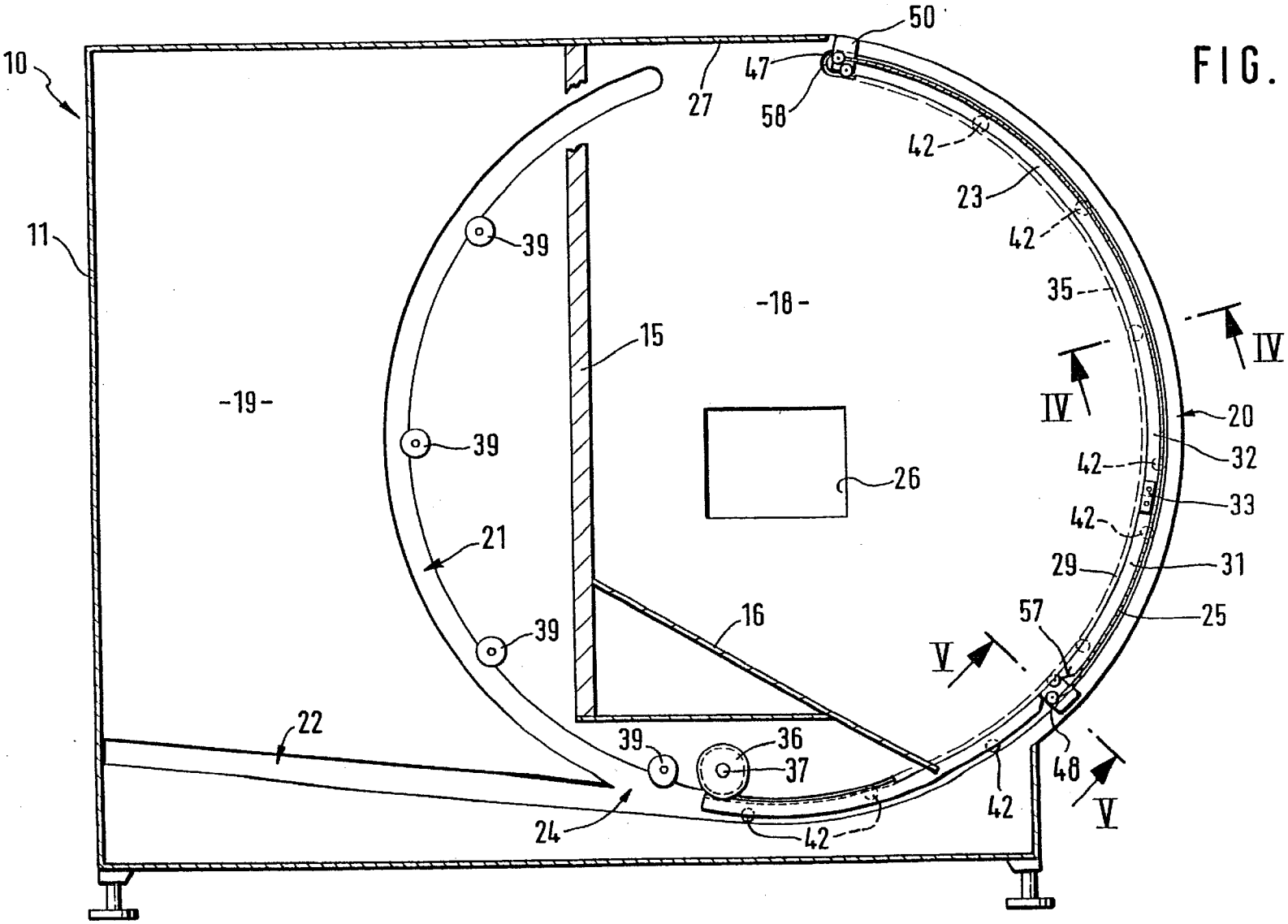

In order to permit the back edge 48 of the protective plate 25 and the connecting angle 51 to be situated in the vicinity of the guides 21 and in contact with the guiding and forming strips 23 when the housing 11 is closed, then a recess 57 is embodied on the side of each guiding and forming strip 23 opposite from the gearing 35 and the leg 53 and the rollers 54 are disposed in the vicinity of this recess (FIG. 3).

A connecting angle 51 with rollers 54 is also disposed on the front edge 47 of the protective plate 25. In this connection, it is essential that the region of the front edge 47 of the protective plate 25, which approximately ends with the front end 58 of the guiding and forming strip 23, is connected to the two guiding and forming strips 23 with frictional or positive engagement so that a movement of the protective plate 25, goes hand in hand with a corresponding movement of the guiding and forming strips 23. A positively engaging coupling of the protective plate 25 with the guiding and forming strips 23 can occur by virtue of the fact that a part of the connecting angle 51 engages in a corresponding recess in the guiding and forming strips 23, while a frictional connection can be produced by fastening the leg 53 to the guiding and forming strips 23.

Figure 2:
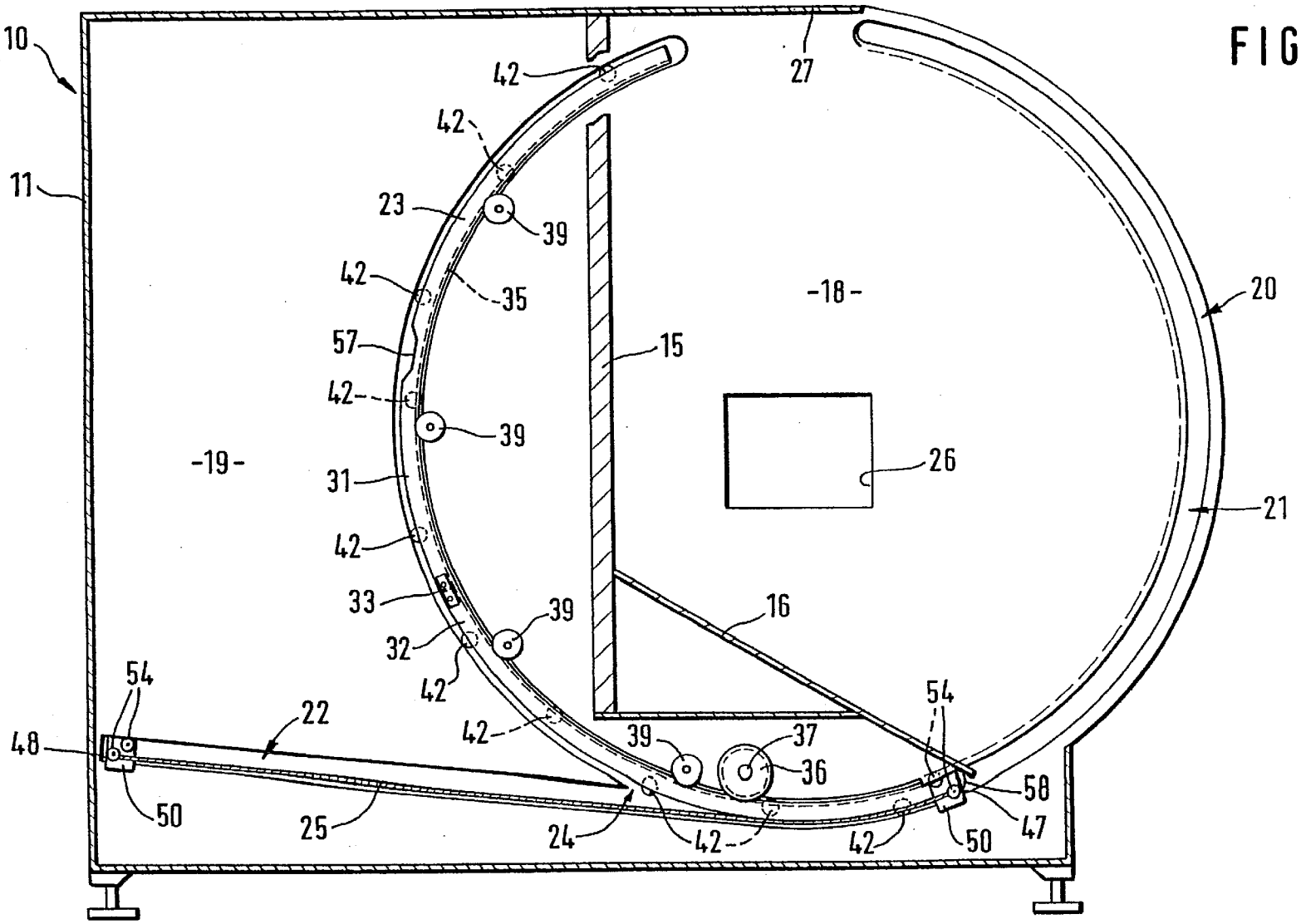
FIGS. 2 and 3 show simplified cross sections through the packaging machine according to FIG. 1, with different positions of the protective plates.

The opening and closing of the housing 11 will be described below in conjunction with FIGS. 2 and 3: When the housing 11 is open (FIG. 2), the protective plate 25 is essentially disposed in the vicinity of the straight guides 22, while the guiding and forming strips 23 are disposed in the back region of the arc-shaped guides 21. In this connection, the bottom covering 16 is designed so that the bottom covering still covers the front edge 47 of the protective plate 25 when the housing 11 is open. If the housing 11 is subsequently closed, then this occurs with a manual actuation by pulling the protective plate 25 up by the front closing and grasping strip 50, which can also be equipped with an additional grip (not shown) for this purpose. Due to the coupling of the protective plate 25 to the two guiding and forming strips 23, the protective plate 25 is transferred from the straight guide 22 into the arc-shaped guide 21. At the same time, the two guiding and forming strips 23 travel out of the back part of the housing 11 into the vicinity of the production chamber 18.

In this connection it is essential that the protective plate 25, which is guided as a flat plate in the straight guide 22, is gradually curved in accordance with the contour of the arc-shaped guide 21 as the flat plate moves over into this guide 21 by virtue of the fact that the protective plate 25 nestles against the side of the guiding and forming strips 23 opposite from the gearing 35. An appropriate dimensioning of the intermediary space 46 of the guide 21 which the protective plate 25 protrudes into assures that the protective plate 25 does not touch the groove side wall 44. This prevents a sliding friction between the protective plate 25 and the guide 21 so that the housing 11 can be closed with a slight exertion of force since at the same time, the two guiding and forming strips 23 can also be easily moved due to their rollers 42. In cooperation with the disposition of the connecting angle 51 and the rollers 54, the guide 22 is also dimensioned so that the protective plate 25 is guided in an at least almost contact-free manner inside the straight guide 22. When the housing 11 is completely closed (FIG. 3), the front closing and grasping strip 50 adjoins the upper housing wall 27 so that the production chamber 18 is completely closed. In addition, the gearings 35 of the two guiding and forming strips 23 remain engaged with the gearings of the gears 36.

The housing 11 is opened by sliding back or pivoting down the protective plate 25. In this connection, the two guiding and forming strips 23 roll in the arc-shaped guides 21 while the back edge 48 of the protective plate 25, with the connecting angle 51 and the rollers 54, travels into the straight guide 22 in the vicinity of the branch 24.

In addition, the shaft 37 is not only used to introduce a torque into the guiding and forming strips 23 by means of the gears 36 when the protective plate 25 is operated by a motor. On the contrary, in the above-described manual movement of the protective plate 25, the protective plate 25 is prevented from tilting in the guides 21, 22 even in the event of a one-sided introduction of force into the closing and grasping strip 50, since the shaft 37 couples the two guiding and forming strips 23 to each other.

In the first exemplary embodiment of the invention described above and shown in FIGS. 1 to 5, a one-piece protective plate 25 is used, which extends over the entire width of the housing 11. In lieu of one protective plate, it is also possible to use a number of protective plates of different widths. In this case, the side walls of the housing are not embodied of one piece, but are comprised at least partially of a number of parts, which are disposed spaced apart from each other at different distances. Then, for example, the one protective plate in the lower region of the packaging machine extends over its entire width, while the other protective plate in the upper region only extends over part of the width. In an embodiment of this kind with two protective plates, it is useful to be able to pivot the upper protective plate upward; this upper protective plate is disposed in the upper region so that when the housing is open, it is possible to access the unite disposed in the drive chamber.

The second exemplary embodiment of the invention shown in FIGS. 6 to 9 departs from the principle of the guiding and forming strips 23 against which the protective plate 25 nestles. In this embodiment, the packaging machine 10*a* has a housing 11*a* whose side walls 20*a* have guides 60, 61 embodied in them for protective plates 62, 63, where the two guides 60, 61 extend parallel to each other over a wide region. The guide 60 associated with the protective plates 62 has an arc-shaped first section 64 in the vicinity of the production chamber 18*a* and a second straight section 66 disposed in the bottom region of the packaging machine 10*a*. The other guide 61 also has a first arc-shaped section 67 in the vicinity of the production chamber 18*a* and a second straight section 68 in the bottom region of the packaging machine 10*a*. The guide 61 disposed on the side of the guide 60 remote from the production chamber 18*a* is embodied so that it is longer than the guide 60 in its upper region so that its protective plate 63 can also cover the upper region of the production chamber 18*a*. In the bottom region of the packaging machine 10*a*, the two straight section 66, 68 of the two guides 60, 61 are disposed inside a storage space 69 whose size is adapted to the size of the protective plates 62, 63.

The two essentially rectangular protective plates 62, 63 are each comprised of a transparent material, in particular plexiglass. Whereas the one protective plate 62 is embodied as a flat, flexible plate, which adapts to the shape of the section 64 as will be explained in more detail below, the other protective plate 63 is already provided with a curvature that is adapted to the arc-shaped section 67.

The two protective plates 62, 63 cooperate with each other in a louver-like manner, i.e. they can be slid one over the other in a space-saving manner. In order to permit the easiest possible opening and closing of the production chamber 18*a*, each of the protective plates 62, 63, in its horizontal edge regions, also has two-part protecting and guiding strips 71, 72, and 74, 75, which are respectively disposed in the vicinity of the top and bottom of the protective plate 62, 63. When the closed production chamber 18*a* is opened according to FIG. 1, it is consequently sufficient to move the one shorter protective plate 63 in the direction of the storage space 69, whereby the other longer protective plate 62 is carried along with it as soon as the bottom of the protecting and guiding strip 74 strikes against the top of the protecting and guiding strip 71. Conversely, when the open production chamber 18*a* is closed according to FIG. 2, the protective plate 63 carries the protective plate 62 along with it as soon as the bottom of the protecting and guiding strip 75 strikes against the bottom of the protecting and guiding strip 71.

In addition to the above-mentioned catching function of the protective plate 62, 63 during opening and closing of the production chamber 18*a*, the protecting and guiding strips 71, 72 and 74, 75 also have the particular task of bringing the protective plate 62, 63 into operative connection with the guides 60, 61. In the case of the protective plate 63, the guide 61 is embodied as a respective groove in the side walls 20*a* on the side oriented toward the production chamber 18*a*. The grooves are each engaged by respective rollers 76, 77 which are disposed on both sides of the protecting and guiding strips 74, 75. The protecting and guiding strips 74, 75 and the protective plate 63 have a width that approximately corresponds to the distance between the two side walls 20*a*. This results in the fact that the protective plate 63 ends essentially flush with the side walls 20*a* which prevents the penetration of dust or dirt when the production chamber 18*a* is closed. At the same time, a relatively favorable noise damping of production chamber 18*a* is produced in relation to the outside. In the case of the protective plate 62, the guide 60 is embodied in a geometrically complex manner which will be referred to below in conjunction with FIGS. 8 and 9.

Figure 9:
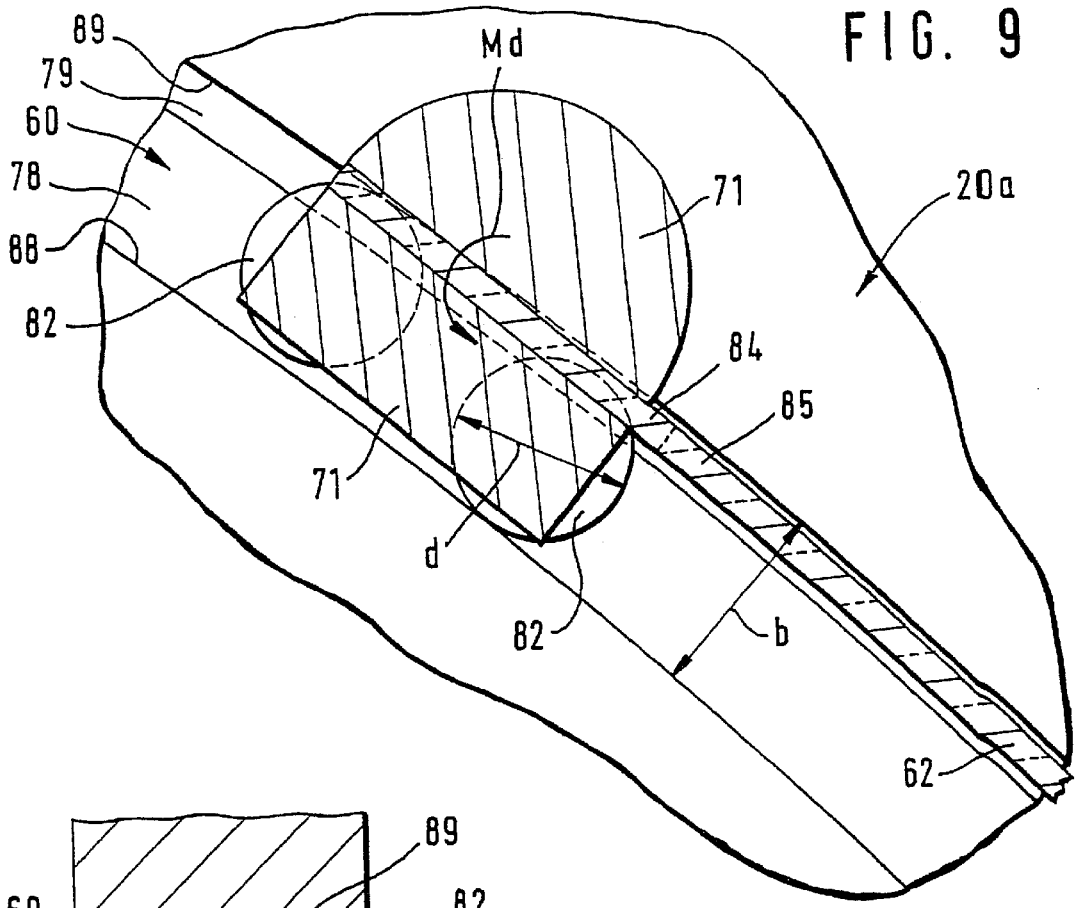
FIG. 9 shows a detail from FIG. 6.
Figure 8:
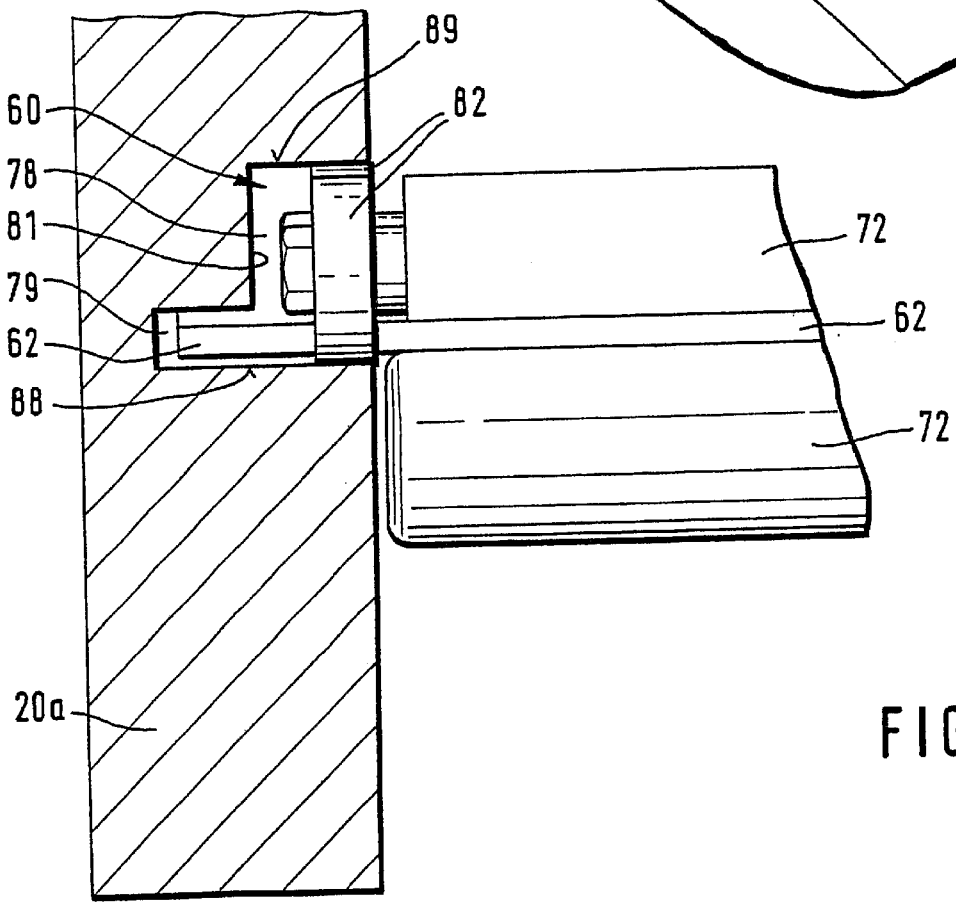
FIG. 8 shows a view in the plane VIII—VIII in FIG. 6.

The guides 60 in the side walls 20*a* each have two guide sections 78, 79. The one guide section 78 is embodied as a rectangular groove path. The groove bottom 81 of the guide section 78 is adjoined by the guide section 79, which is likewise embodied as a groove path. Consequently, the guide 60 has a greater groove depth in the vicinity of the guide section 79 than in the vicinity of the guide section 78, wherein the width of the guide section 79 is greater the thickness of the protective plate 62 so that the protective plate 62 is disposed in the guide section 79 with play. The guide section 78 in each of the side walls 20*a* is used to guide two rollers 82 of the same diameter d, which are disposed on the side of the protective plate 62 oriented toward the production chamber 18*a*, on the undersides of the protecting and guiding strips 71, 72, where the diameter d of the rollers 82 is respectively smaller than the width b of the guide section 78 (FIG. 9).

In the vicinity of the protecting and guiding strips 71, 72, the protective plate 62 has edge regions 84 in which the width of the protective plate 62 approximately corresponds to the distance between the two side walls 20*a* or the width of the protecting and guiding strips 71, 72. In contrast, in its inner region 85, the protective plate 62 has a width which extends into the guide section 79, which gives the production chamber 18*a* a high resistance to dirt and a favorable noise damping. The inner region 85 of the protective plate 62 is consequently guided in the guide section 79 whereas the edge regions 84 are disposed outside the guide 60.

In order to reduce the friction of the protective plate 62 in the guide section 79 of the guide 60 so that the displacement forces are low when the protective plate 62 moves in the guide 60, the protective plate 62 is prestressed in an arc shape in the vicinity of the section 64 of the guide 60 through the introduction of bending moment Md in the vicinity of the protecting and guiding strips 71, 72. The initial stress or the magnitude of the bending moment Md introduced is selected so that the curvature of the protective plate 62 resulting from the stress corresponds to the curvature of the guide section 79 to the greatest degree possible so that the protective plate 62 is disposed in the guide section 79 in a contact-free manner.

The introduction of the bending moment Md into the protective plate 62 by means of the protecting and guiding strips 71, 72 takes place via the rollers 82 in the guide 60 in cooperation with the dimensioning of the diameter d of the rollers 82 and the width b of the guide section 78. As a result, the bond of the two rollers 82 and the protective plate 62 is disposed under bending stress in the guide section 78, wherein the roller 82 oriented toward the inner region the guide section 78 one roller 82 rests against the inner groove wall 88 while the other roller 82 rests against the outer groove wall 89.

Figure 7:
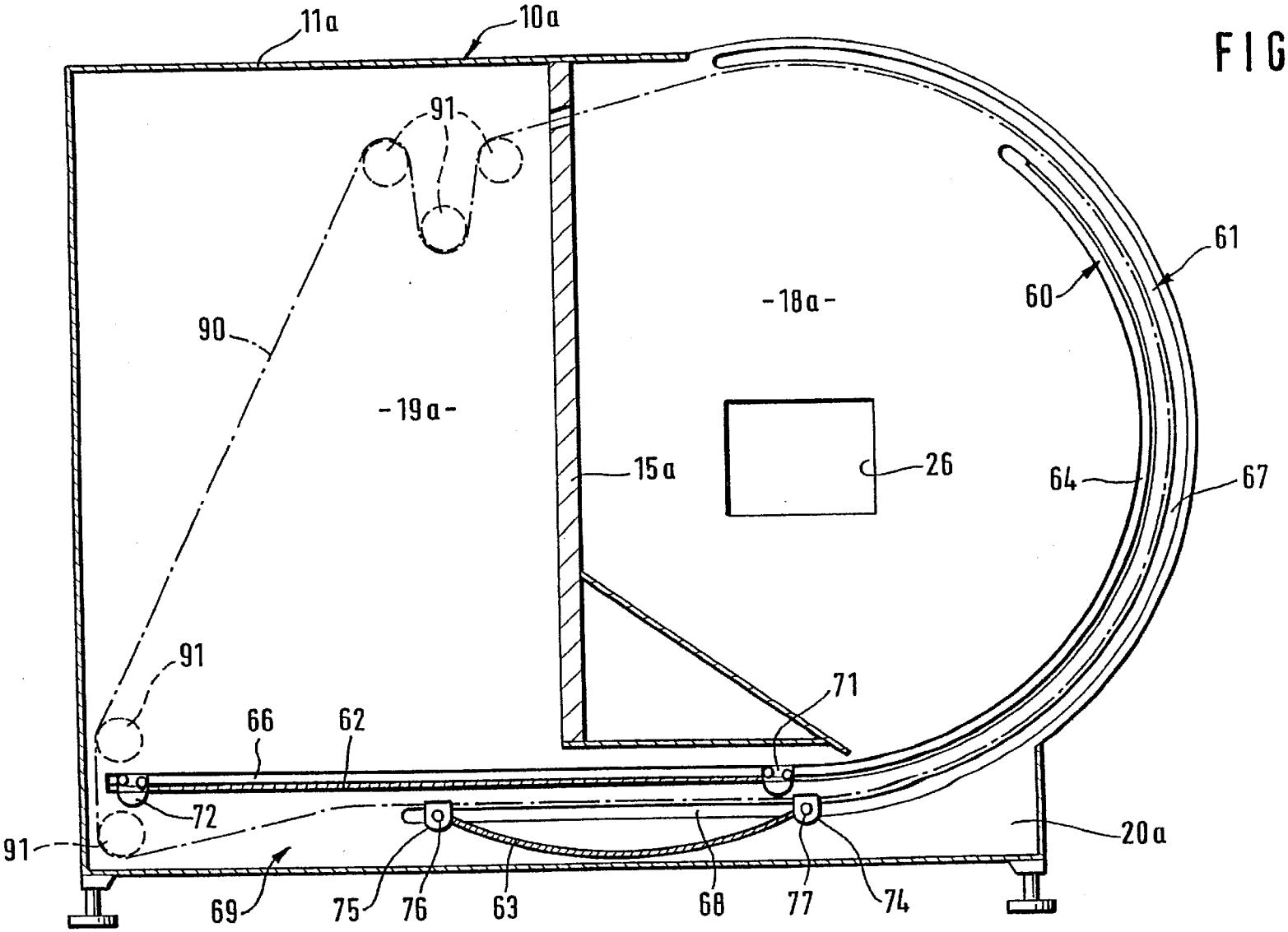

In addition, in order to further reduce friction, it is useful to enlarge the groove width b of the guide 60 in the vicinity of the straight bottom section 66 in such a way that the protective plate 62 there is disposed in the guide section 79 as a flat plate (as shown in FIG. 7), without bending moment. In this instance, when the housing 11*a* of the packaging machine 10*a* is closed, the protecting and guiding strip 75 of the protective plate 63 carries the protective plate 62 along with it out of the bottom section 66 of the guide 60. During the passage into the arc-shaped section 64, as a result of the above-described embodiment, a bending moment Md is introduced into the protective plate 62, which leads to a bending of the protective plate 62 in accordance with the curvature of the section 64. During the entire movement of the protective plate 62 in the guide 60, there is no contact or only minimal contact of the protective plate 62 with the guide 60 so that the opening and closing of the housing 11*a* can occur with a relatively slight exertion of force.

The housing 11*a* can likewise be opened and closed not only manually but also by means of a motor. To that end, in the exemplary embodiment according to FIGS. 6 and 7, an endless chain drive 90 is indicated, which is connected to one of the protective plates 62, 63 and in the vicinity of the production chamber 18*a,* travels in a guide groove that is not shown. The chain drive 90 is deflected by means of a number of gears 91 and one of the gears 91 is operationally connected to a drive mechanism.

In a modification of the second exemplary embodiment according to FIGS. 6 to 9, one or more flat protective plates can be used, which correspond to the protective plate 62 and into which a corresponding bending moment can be introduced in the above-described manner in order to reduce frictional forces. A housing with one or more precurved protective plates that correspond to the protective plate 63, but without a flat protective plate 62 is also conceivable.

Furthermore, in both exemplary embodiments, it is possible to embody individual sections of the protective plates 25, 62, 63 as partially opaque, for example by means of gluing a foil to it, so that when the housing 11, 11*a* is closed, only the relevant regions inside the packaging machine 10, 10*a* can be seen.

Finally, the use of the housing 11, 11*a* is not limited to packaging machines 10, 10*a*. Other manufacturing devices or housings of a general nature, by means of the embodiment according to the invention, permit an easy access to a closed region from the front side of the housing without additional space outside the housing being required in order to open the housing.

The foregoing relates to preferred exemplary embodiments of the invention, it being understood that other variants and embodiments thereof are possible within the spirit and scope of the invention, the latter being defined by the appended claims.

We claim:

1. A housing (11), having a front side and side walls (20) for a packaging machine (10), comprising at least one protective plate (25), which is at least partially comprised of a transparent material and is disposed on the front side of the housing (11), wherein the protective plate (25) is supported by means of guides (21, 22) in the side walls (20) of the housing (11), and in order to clear a chamber (18) disposed inside the housing (11), the protective plate (25) can be moved in the guides (21, 22), wherein one of the guides (21) is arc-shaped, on the front side of the housing (11), and wherein the other of the guides (22) has an essentially straight section for the protective plate (25), the protective plate (25) is a flat, flexible plate, an arc-shaped bending element (23) is movably disposed in a region of the arc-shaped guide (21) at a front edge (47), the protective plate (25) is connected with a front edge (58) of the bending element (23), and said straight section guide (22) for the protective plate (25) branches off from the arc-shaped guide (21) so that the protective plate (25) nestles against the bending element (23) as the protective plate passes from the straight section guide (22) into the arc-shaped guide (21).

2. The housing according to claim 1, in which the housing (11) has an essentially vertically extending dividing wall (15) that divides the inner chamber of the housing (11) into two regions (18, 19), and the essentially straight section is disposed in the bottom region of the housing (11) so that both regions (18, 19) can be accessed if the protective plate (25) is disposed in the straight section of the guides (21, 22).

3. The housing according to claim 2, in which the guides (21, 22) are embodied as groove paths and rollers (54) roll in the groove paths and are connected with the protective plate (25) in a vicinity of the front and the back edge (47, 48).

4. The housing according to claim 3, in which the groove paths have a separate groove section (46) for guiding the protective plate (25).

5. The housing according to claim 1, in which the guides (21, 22) are embodied as groove paths and rollers (54) roll in the groove paths and are connected with the protective plate (25) in a vicinity of the front and the back edge (47, 48).

6. The housing according to claim 5, in which the groove paths have a separate groove section (46) for guiding the protective plate (25).

7. The housing according to claim 1, in which the bending element (23) has gearings (35) on the side remote from the protective plate (25), the gearings (35) each engage with a respective gear (36) in the side walls (20), and the gears (36) are coupled to each other by means of a shaft (37).

8. A housing. (11*a*), having a front side and side walls (20*a*) for a packaging machine (10*a*), comprising at least one protective plate (62, 63), which is at least partially comprised of transparent material and is disposed on the front side of the housing (11*a*), wherein said at least one protective plate (62, 63) is supported (by means of guides (60, 61) in the side walls (20*a*) of the housing (11*a*), and in order to clear a chamber (18*a*) disposed inside the housing (11*a*), said at least one protective plate can be moved in the guides (60, 61), wherein the guides (60, 61) are arc-shaped, at least on the front side of the housing (11*a*), and wherein the guides (60, 61) have an essentially straight section (66, 68) for said at least one protective plate (62, 63), said at least one protective plate (62) is a flat, flexible plate, a guide strip (71, 72) is connected to a front and a back edge of protective plate (62) from said at least one protective plate (62, 63) each of the guide strips has two rollers (82) fastened to the guide strips on each side of the protective plate (62), and the rollers (82) on one guide strip (71, 72) on each side of the protective plate (62) have a different distance (a1, a2) to the protective plate (62) so that in a transition into an arc-shaped first section (64) of the guide (60), a bending moment (Md) is introduced into the protective plate (62), which produces a curvature in the protective plate (62) that corresponds to a curvature of the arc-shaped first section (64) of the guide (60).

9. The housing according to claim 8, in which the housing (11*a*) has an essentially vertically extending dividing wall (15*a*) that divides the inner chamber of the housing (11*a*) into two regions (18*a,* 19*a*), and the essentially straight section (66, 68) is disposed in the bottom region of the housing (11*a*) so that both regions (18*a,* 19*a*) can be accessed if the at least one protective plate (62, 63) is disposed in the straight section (66, 68) of the guides (60, 61).

10. The housing according to claim 9, in which the guides (60, 61) are embodied as groove paths and rollers (76, 77, 82) roll in the groove paths and are connected with the at least one protective plate (62, 63) in a vicinity of the front and the back edge.

11. The housing according to claim 10, in which the groove paths have a separate groove section (79) for guiding the at least one protective plate (62, 63).

12. The housing according to claim 8, in which the guides (60, 61) are embodied as groove paths and rollers (76, 77, 82) roll in the groove paths and are connected with the at least one protective plate (62, 63) in a vicinity of the front and the back edge.

13. The housing according to claim 12, in which the groove paths have a separate groove section (79) for guiding the at least one protective plate (62, 63).

14. The housing according to claim 8, in which the at least one protective plate comprises a number of protective plates (62, 63), the number of protective plates cooperate with one another in telescope fashion, wherein the guides (60, 61) are associated separately with each protective plate (62, 63).

* * * * *